US005640878A

United States Patent [19]

Hinson

[11] Patent Number: 5,640,878

[45] Date of Patent: Jun. 24, 1997

[54] FIXED HEIGHT DRIVE-ON RACK

[76] Inventor: Virgil H. Hinson, 49 Choctaw Sq., Brunswick, Ga. 31525

[21] Appl. No.: 492,634

[22] Filed: Jun. 20, 1995

[51] Int. Cl.[6] ..... B21J 13/08

[52] U.S. Cl. ..... 72/457; 72/705

[58] Field of Search ..... 72/705, 447, 457

[56] References Cited

U.S. PATENT DOCUMENTS

| | | | |
|---|---|---|---|
| 4,236,400 | 12/1980 | Specktor | 72/461 |
| 4,313,335 | 2/1982 | Eck | 72/705 |
| 4,398,410 | 8/1983 | McWhorter et al. | 72/705 |
| 4,442,608 | 4/1984 | Clausen | 33/288 |
| 4,530,232 | 7/1985 | Smith | 72/705 |
| 4,574,614 | 3/1986 | Field | 72/447 |
| 4,660,405 | 4/1987 | Widegren et al. | 72/447 |
| 4,848,132 | 7/1989 | Saroli | 72/705 |
| 5,199,289 | 4/1993 | Hinson | 72/457 |
| 5,239,854 | 8/1993 | Hinson | 72/457 |
| 5,257,526 | 11/1993 | Teixeria | 72/705 |

*Primary Examiner*—Lowell A. Larson
*Assistant Examiner*—Ed Tolan
*Attorney, Agent, or Firm*—Jacobson, Price, Holman & Stern, PLLC

[57] ABSTRACT

An elongated vehicle repair rack is provided including front and rear ends and opposite side longitudinal margins. At lease one pull tower is mounted from a corresponding ramp margin and includes power structure for exerting an outward pull, at two different rates and magnitudes and at adjustable height above the rack, on a vehicle mounted on the rack. A chain pull down structure is also provided for ready anchoring to and adjustable shifting along one of the rack margins and the rear end of the rack is provided with pivoted power ramp structure from which rearward pulls on a vehicle mounted on the rack may be effected when the ramp structure is in a raised position.

10 Claims, 6 Drawing Sheets

FIXED HEIGHT DRIVE-ON RACK

BACKGROUND OF THE INVENTION

1. Field of the Invention

This invention relates to a vehicle body/frame straightening rack and accessories therefor which enable a high majority of body and/or frame straightening pulls to be applied to various vehicle components once the vehicle has been anchored in position on the rack and with the "set up" required for each pull to be effected in a minimum of time.

2. Description of Related Art

Various different forms of racks, racks having loading ramps therefor, racks provided with structures for exerting generally horizontal pulls on vehicles supported therefrom, racks including vehicle support structures, racks including means for exerting generally horizontal pulls on vehicles supported therefrom at different elevations, rack supported accessories mounted for adjustable positioning along the associated racks and racks having pull towers adjustably supported therefrom for movement longitudinally therealong heretofore have been known. Examples of these previously known devices are disclosed in U.S. Pat. Nos. 4,236,400, 4,442,608, 4,574,614, 4,660,405, 5,199,289 and 5,239,854. However, these previously known devices do not include the overall structural and operational features of the rack, pull tower, loading ramp and hold down structure of the instant invention.

SUMMARY OF THE INVENTION

When straightening a vehicle frame and/or body, it is necessary, in different instances, to exert not only horizontal lateral pulls as well as longitudinal pulls, but to also vary the height of such pulls as well as the angulation thereof in a vertical plane.

While many racks and accessories therefor are capable of effecting some of such pulls, few are capable of effecting all such pulls. Further, while some racks have closed front ends from which longitudinal pulls may be effected, others have ramp equipped rear ends from which rearward pulls may not be effected. Also, many racks and their pull effecting accessories require considerable set-up time to arrange the various components thereof for effecting the desired pulls. Still further, many pull effecting rack towers require considerable time to effect chain slack take-up. Accordingly, although straightening racks have been constantly further developed and upgraded since their inception, a need exists for considerably improved racks which will be capable of effecting many different types of pulls, including rearward pulls by racks equipped with rear loading ramps, which will require as little set-up time as possible to effect the various pulls available and which include pull towers capable of rapid chain slack take-up.

The main object of this invention is to provide a vehicle frame and/or body straightening rack for stationarily supporting a vehicle thereon and which may be utilized, together with various accessories provided, to exert as many pulls as may be needed in order to complete a desired straightening operation.

Another object of this invention is to provide a rack having a closed front end from which longitudinal pulls may be effected and including a ramp equipped rear end to greatly facilitate the loading and unloading of a vehicle on the rack.

Still another important object of this invention, in accordance with the immediately preceding object, is to provide a retractable ramp for the rear end of a rack and which may be utilized for effecting rearward pulls on vehicles mounted on the rack.

Another very important object of this invention is to provide a rack including at least one pull tower moveable along the periphery of the rack and including structure for rapid pull chain slack take-up.

A further object of this invention is to provide a rack pull tower including a removable upward extension and constructed in a manner whereby a single high pull may be effected from the pull tower or a high pull in combination with a lower pull may be effected, each of the pulls being independently effected.

A still further object of this invention is to provide a retractable ramp structure for the rear end of a rack from which both high and low rearward pulls may be independently exerted.

Yet another object of this invention is to provide a rack pull down roller assembly constructed in a manner such that it may be readily removably anchored to the associated rack and shifted longitudinally therealong.

A final object of this invention to be specifically enumerated herein is to provide a vehicle frame/body straightening rack in accordance with the preceding objects and which will conform to conventional forms of manufacture, be of simple construction and easy to use in a minimum amount of time so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
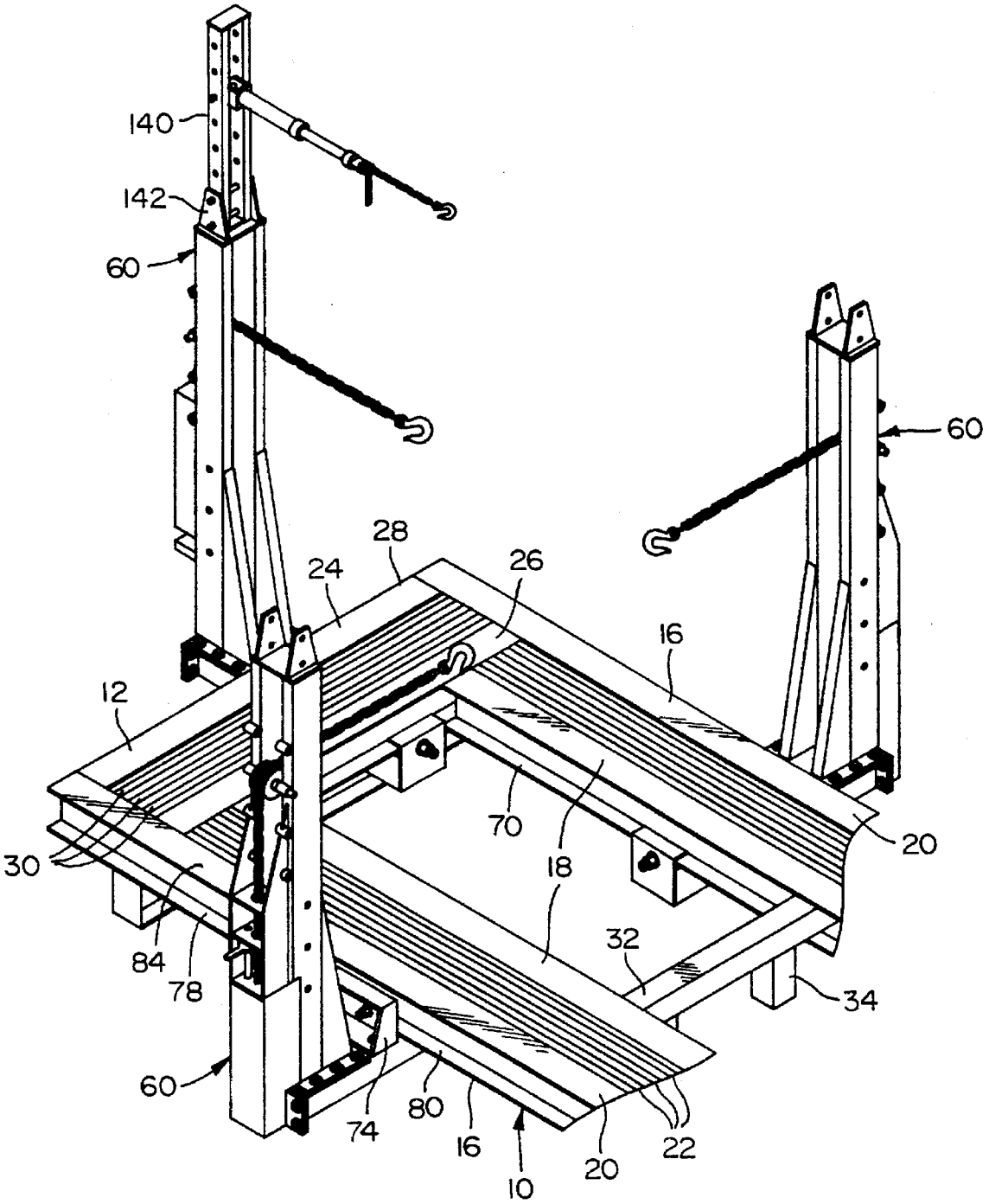
FIG. 1 is a fragmentary perspective view of the front end of a rack constructed in accordance with the present invention and from which a pair of opposite side pull towers as well as a front end pull tower are supported, the front end pull tower including an upward extension thereof having an independently actuatable pull member operatively associated therewith.
Figure 2:
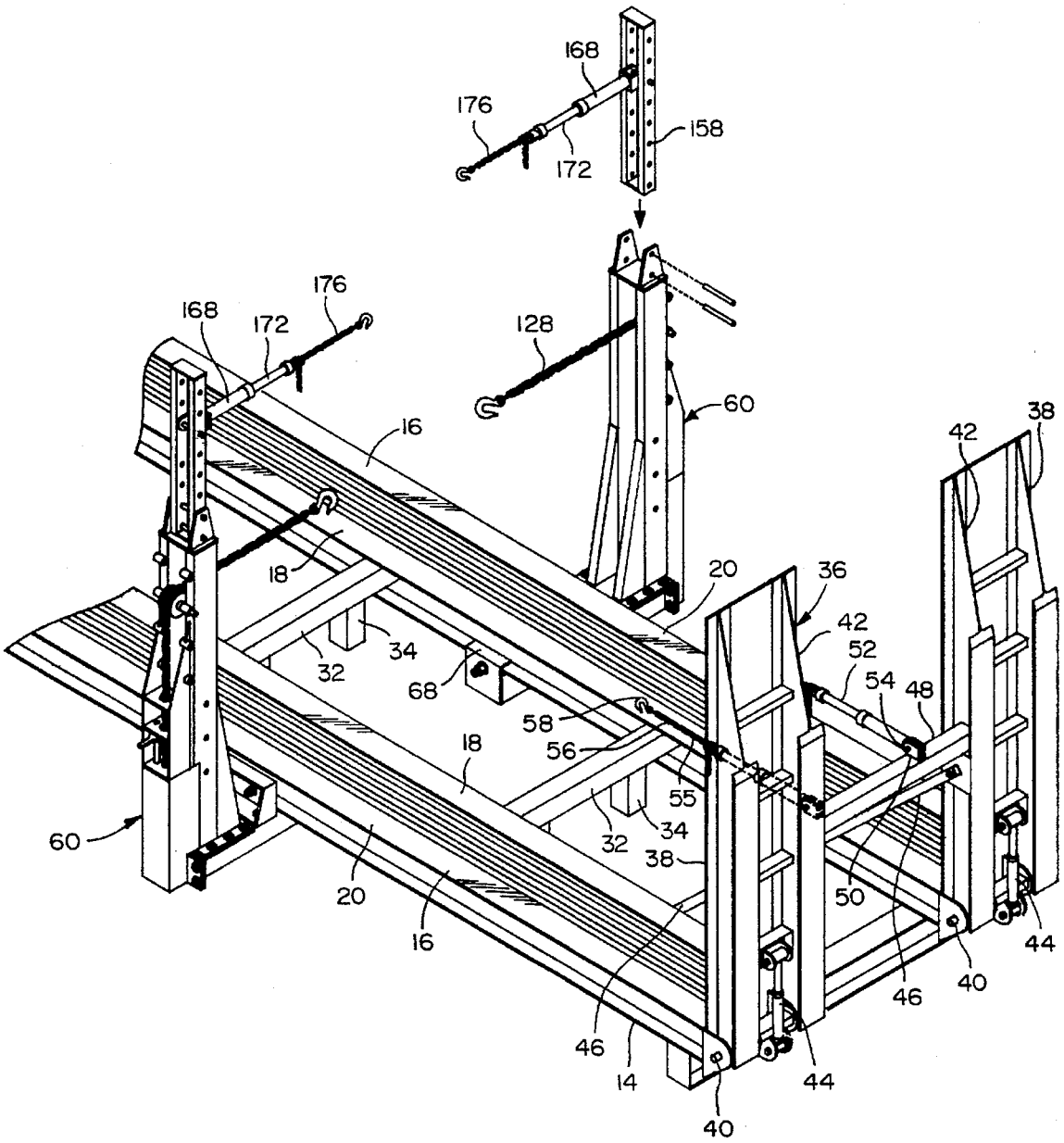
FIG. 2 is a fragmentary perspective view of the rear end of the rack of FIG. 1 illustrating a pair of upward extension equipped pull towers supported from the opposite sides thereof and illustrating a loading ramp for the rear end of the rack in an upwardly retracted position and equipped with independently operable pull members.

Referring now more specifically to the drawings and to FIGS. 1 and 2 in particular, the reference numeral 10 generally designates a vehicle rack in accordance with the present invention including front and rear ends 12 and 14. The rack 10 includes opposite side longitudinal marginal portion treadways 16 each including a pair of inner and outer I-beams 18 and 20 disposed in laterally spaced relation and having a set of three longitudinal tubular members 22 disposed therebetween (see FIG. 10), the I-beams 18 and 20 as well as the tubular members 22 being rigidly interconnected in any convenient manner.

The front ends of the treadways 16 are rigidly interconnected through the utilization of a front transverse member 24 constructed similarly to treadways 16 and including inner and outer I-beams 26 and 28 and a set of three tubular members 30 corresponding to the tubular members 22, see FIG. 1.

The treadways 16 are rigidly interconnected throughout their length by transverse members 32 including depending foot portions 34 operative to support the treadways 16 of the rack 10 in elevated position above a suitable flooring (not shown).

The rear end 14 of the rack 10 includes a ramp assembly referred to generally by the reference numeral 36 and including a pair of elongated ramp members 38 pivotally supported from the rear ends of the treadways 16 as at 40, see FIG. 2. The ramp assembly 36 is illustrated in FIG. 2 in a vertical raised position and may be pivoted rearwardly and downwardly past a horizontal position to a downwardly inclined lowered position with the bevelled portions 42 at the free ends of the ramp members 38 contacting a horizontal surface upon which the foot portions 34 are supported. In this manner, a vehicle to be straightened may move upwardly along the ramp members 38 and onto the treadways 16 when the ramp assembly 36 is in its lowered position.

A pair of simultaneously actuable hydraulic cylinders 44 are interconnected between the rear ends of the treadways 16 and the pivoted end portions of the ramp members 38 and may be utilized to swing the ramp assembly 36 between the raised position illustrated in FIG. 2 and the aforementioned rearwardly and downwardly inclined lowered position.

Once the ramp assembly 36 has been swung to the raised position illustrated in FIG. 2, removable inclined braces 46 may be secured between the ramp members 38 and the corresponding treadways 16 in order to brace the ramp assembly 36 in the raised position. A transverse brace 48 extends between and rigidly interconnects the ramp members 38 centrally intermediate their opposite ends. Brace 48 also has mounting brackets 50 supported from the opposite end portion thereof from which the base ends of a pair of independently operable hydraulic cylinders 52 are pivotally anchored as at 54. The free ends of the hydraulic cylinders 52 each have the base end portion 55 of a pull chain 56 adjustably anchored thereto. The free end of each pull chain 56 is equipped with a hook 58.

Figure 3:
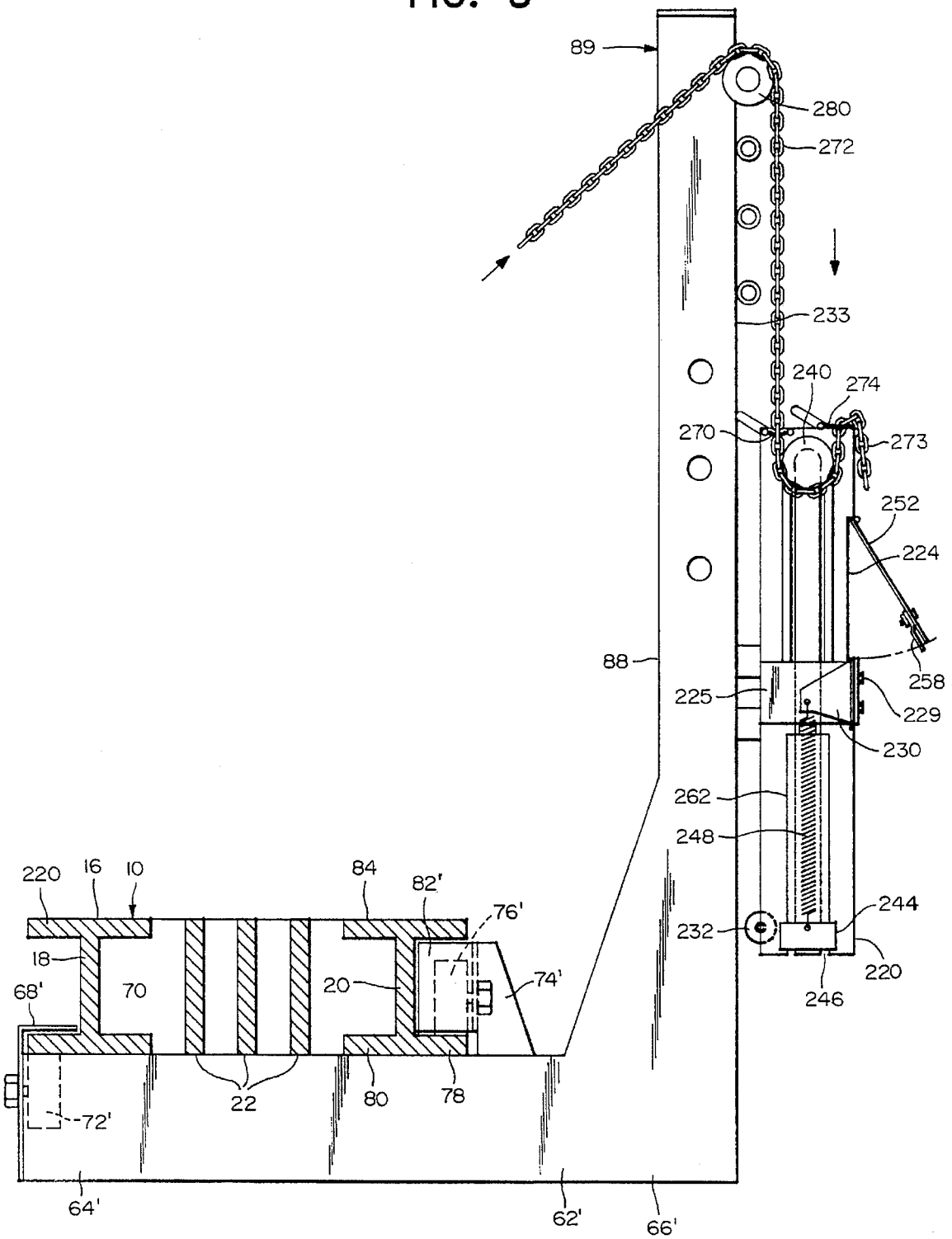
FIG. 3 is an enlarged fragmentary transverse vertical sectional view of the right hand side of the rack illustrated in FIGS. 1 and 2 illustrating the structure by which a pull tower is mounted thereon for movement longitudinally therealong, the pull tower being schematically illustrated and having some parts omitted in order to illustrate more clearly the structure by which slack in an associated pull chain may be rapidly taken up during a first portion of a pull and a second portion of a pull may be effected at a slower rate but with twice the power exerted during the first portion of the pull.
Figure 4:
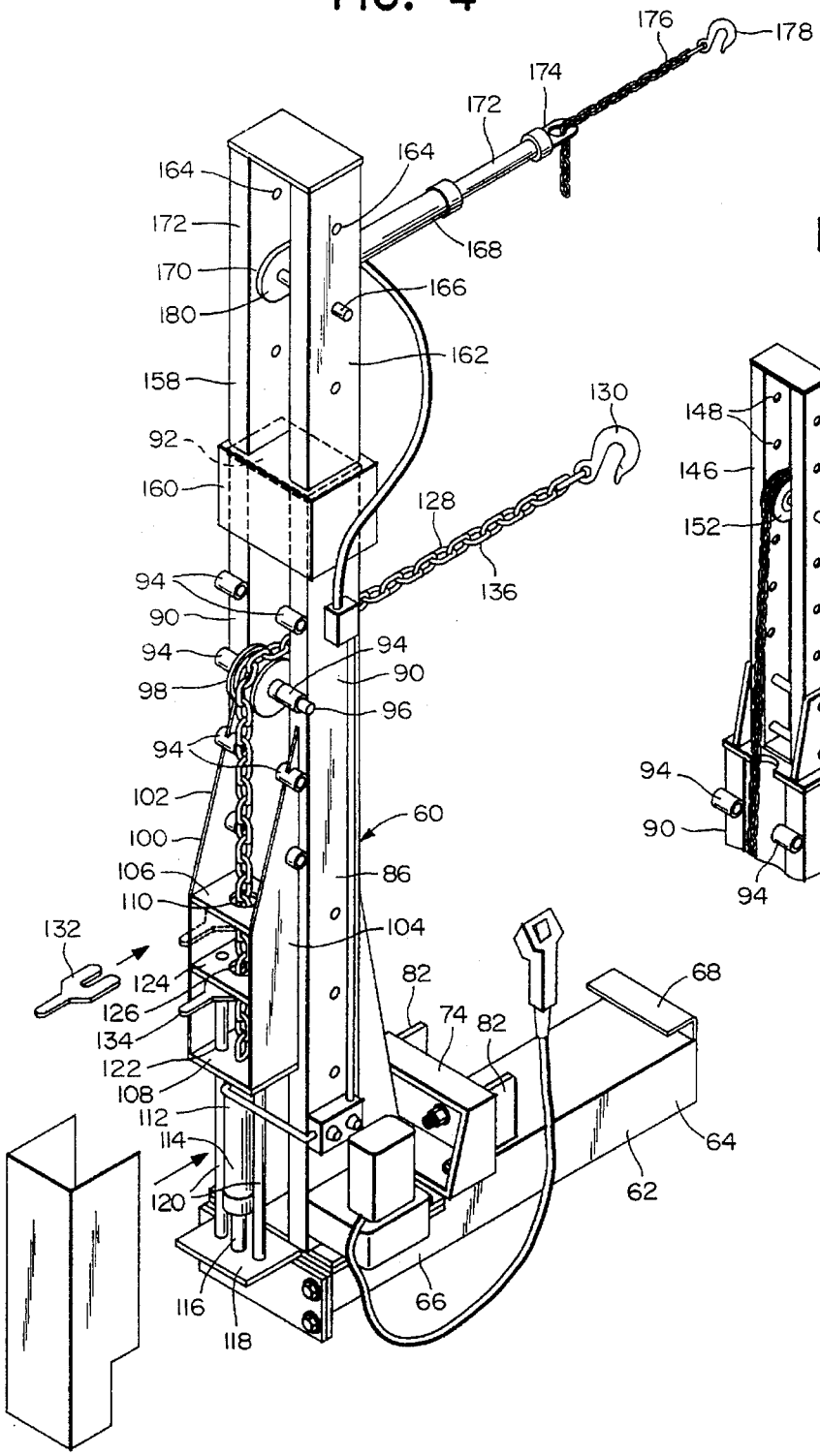
FIG. 4 is a perspective view of a modified form of pull tower constructed in accordance with the present invention illustrating the structure by which successive short pulls may be exerted on an associated vehicle and with the tower equipped with an upward extension supporting an independently operable pull structure.

With attention now invited more specifically to FIGS. 1, 2 and 4 and to FIG. 4 in particular, there will be seen a pull tower referred to generally by the reference numeral 60 which is capable of quickly making a plurality of successive pulls on a vehicle supported from the rack 10. The pull tower 60 includes an elongated transverse base 62 having inner and outer ends 64 and 66 corresponding to the inner and outer ends 64' and 66' of the base 62' of a modified pull tower 89 shown in FIG. 3. The inner end 64 includes an upwardly projecting and back turned flange 68 which hooks over the inner side of the lower flange 70 of the inner I-beam 18. The inner end 64 further includes a first roller assembly in the form of at least one roller, corresponding to the roller assembly 72' of FIG. 3, journaled therefrom and rollingly engaged with the underside of the inner margin of the lower flange 70 through an appropriate window (not shown) formed in the upper wall of the tubular base 62 corresponding to the base 62', see FIG. 3. In addition, the outer end 66 of the base or base portion 62 includes an upstanding bracket 74 supported therefrom and a second roller assembly in the form of at least one roller, corresponding to roller 76' shown in FIG. 3, journaled from the bracket 74 and overlying and rollingly engaged with the upper surface of the outer margin 78 of the lower flange 80 of the outer I-beam 20. The bracket 74 includes laterally spaced opposite side plate portions 82, see FIG. 4, between which the second roller assembly is disposed and which plate portions 82 are closely received in the laterally outwardly opening channel defined by the outer I-beam 20 between the upper and lower flanges 84 and 78 thereof.

Each pull tower 60 also includes an upright 86 as shown in FIG. 4 which corresponds to the upright 88 of the modified form of pull tower 89 illustrated in FIG. 3. The modified pull tower 89 also includes a base 62' corresponding to the base 62 of the pull tower 60.

The upright 88 of pull tower 89 illustrated in FIG. 3 is adapted to exert a horizontal outward pull upon a vehicle (not shown) supported upon the rack 10 and the weight of the upright 88 and the structures supported therefrom to be hereinafter more fully set forth is greater than the weight of the inner end of the base 62' of the pull tower 89. Accordingly, the roller means 76' bears downwardly upon the outer margin 78 of the lower flange 80 and the roller means 72' bears upwardly against the underside of the lower flange 70, see FIG. 3, when the tower 89 is not exerting a horizontal pull. In this condition, the pull tower 89 may be readily shifted longitudinally on the corresponding treadway 16 on which tower 89 is mounted.

However, when a horizontal outward pull is exerted by the pull tower 89 (in a manner to be hereinafter more fully set forth), the upper end of the upright 88 tends to swing slightly to the left, as viewed in FIG. 3 of the drawings. This swing causes the side plate portions 82' to tightly abut upwardly against the adjacent undersurface portions of the upper flange 84 of the I-beam 20 and the flange 68' to bear downwardly against the opposing upper surfaces of the lower flange 70 of the inner I-beam 18. Thus, as soon as a reasonable horizontal pull is exerted upon a vehicle supported from the rack 10, the plate portions 82' and flange 68' tightly grip the I-beams 20 and 18, respectively, and prevent any shifting of the pull tower 89 longitudinally of the associated treadway 16. Of course, the base 62 of the pull tower 60 is constructed in the same manner and therefore functions in the same manner.

Figure 5:
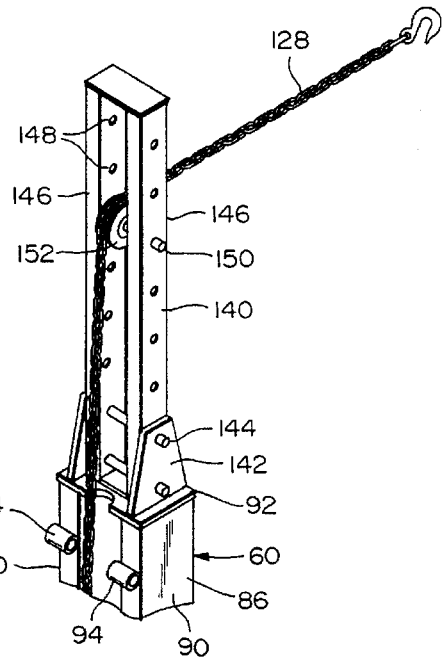
FIG. 5 is a fragmentary perspective view of the upper portion of the pull tower illustrated in FIG. 4 with a different type of upward extension thereon to enable a high pull to be exerted through the use of repetitive short pulls.

The upright 86 illustrated in FIG. 4 of the pull tower 60 includes a pair of laterally spaced upright members 90 interconnected at their upper ends by any convenient structure, such as by a cap plate 92, see FIG. 5, and secured to the base 62 at their lower ends. The upright members 90 include vertically spaced pairs of horizontally aligned sleeves 94 spaced along the outer sides thereof through which the opposite ends of an axle shaft 96 may be selectively engaged, the axle shaft 96 including a pulley 98 journaled thereon intermediate the corresponding sleeves 94.

The lower end of the upright 86 includes a vertically elongated, horizontally outwardly opening housing 100 including opposite side plates 102 and 104 stationarily supported from the upright members 90 as by welding or the like. Between side plates 102 and 104, upper and lower plates 106 and 108 are fixedly secured with the upper plate 106 having a large central opening 110 formed therethrough.

The upper base end 112 of a hydraulic cylinder 114 is secured to the underside of the lower plate 108 and the extendable piston 116 of the cylinder 114 supports a vertically shiftable mounting plate 118 therefrom to which the lower ends of a pair of guide rods 120 are anchored. The guide rods 120 are slidingly received through guide openings 122 provided therefore in the lower plate 108 and have their upper ends attached to opposite side portions of a pull plate 124. The pull plate 124 is vertically slidable in housing 100 and has a central opening 126 formed therethrough corresponding to the opening 110, the cylinder 114 and openings 110 and 126 being aligned along a straight path extending between one peripheral portion of the pulley 98 and the mounting plate 118, see FIG. 4.

A chain 128 has a hook 130 anchored to one end thereof. The chain 128 passes over the pulley 98 and downwardly through the openings 110 and 126. A pair of forked abutment members 132 and 134 are positionable beneath the plates 106 and 124 and may be removably engaged with selected links 136 of the chain 128.

During downward extension of the piston 116, the forked abutment member 134 is engaged with the chain 128 beneath the slidable pull plate 124 so as to pull downwardly on the end of the chain 128 remote from the hook 130. After the piston 116 has been extended, and if it is desired to make a further pull on the chain 128, the forked abutment member 132 is engaged with the chain 128 immediately beneath the fixed plate 106 to hold the chain 128 in its last pulled position. Then, the forked abutment member 134 may be removed and the piston 116 may be retracted. Thereafter, the forked abutment member 134 is again engaged with the chain 128 below the slidable pull plate 124, after which the piston 116 may again be downwardly extended and the forked abutment member 132 may be removed. Accordingly, it may be seen that a pull of substantially any length may be made on the chain 128 by successively actuating the cylinder 114 and alternately engaging the forked abutment members 134 and 132 with the chain 128.

With attention now invited more specifically to FIG. 5, if the upright 86 and the uppermost pair of sleeves 94 are not high enough for effecting the desired pull, the pull tower 60 may be provided with an upper tower extension 140 releasably pinned between upwardly projecting mounting flanges 142 carried by the cap plate 92 through the utilization of attaching pins 144. The extension 140 includes laterally spaced vertical extension members 146 having vertically spaced pairs of registered horizontal bores 148 formed therethrough. Axle shaft 150 corresponding to the axle shaft 96 may be passed through a corresponding pair of bores 148 and have a pulley 152 journaled thereon between the extension members 146. The chain 128 is then passed over the pulley 152.

Still further, a second form of extension 158 is illustrated in FIG. 4 and includes a lower base member 160 defining a downwardly opening socket which may be telescoped downwardly over the upper end 92 of the upright 86 in FIG. 4. The extension 158 includes laterally spaced upward extension members 162 which correspond to the extension members 146 and are provided with vertically spaced pairs of registered horizontal bores 164 through which a removable pivot and anchor pin 166 may be received. An independently operable hydraulic cylinder 168 includes a bifurcated mount 170 on the base end of the cylinder and an extendable piston 172. Attached to the outer end of piston 172 is a chain anchor 174 by which successive links of a chain 176 may be anchorably engaged. The chain 176 has a hook 178 on its free end. The bifurcated mount 170 is releasably anchored to the extension 158 through the utilization of the pin 166 whose opposite end portions pass through not only a selected pair of the bores 164 but also the furcations 180 of the mount 170.

Figure 6:
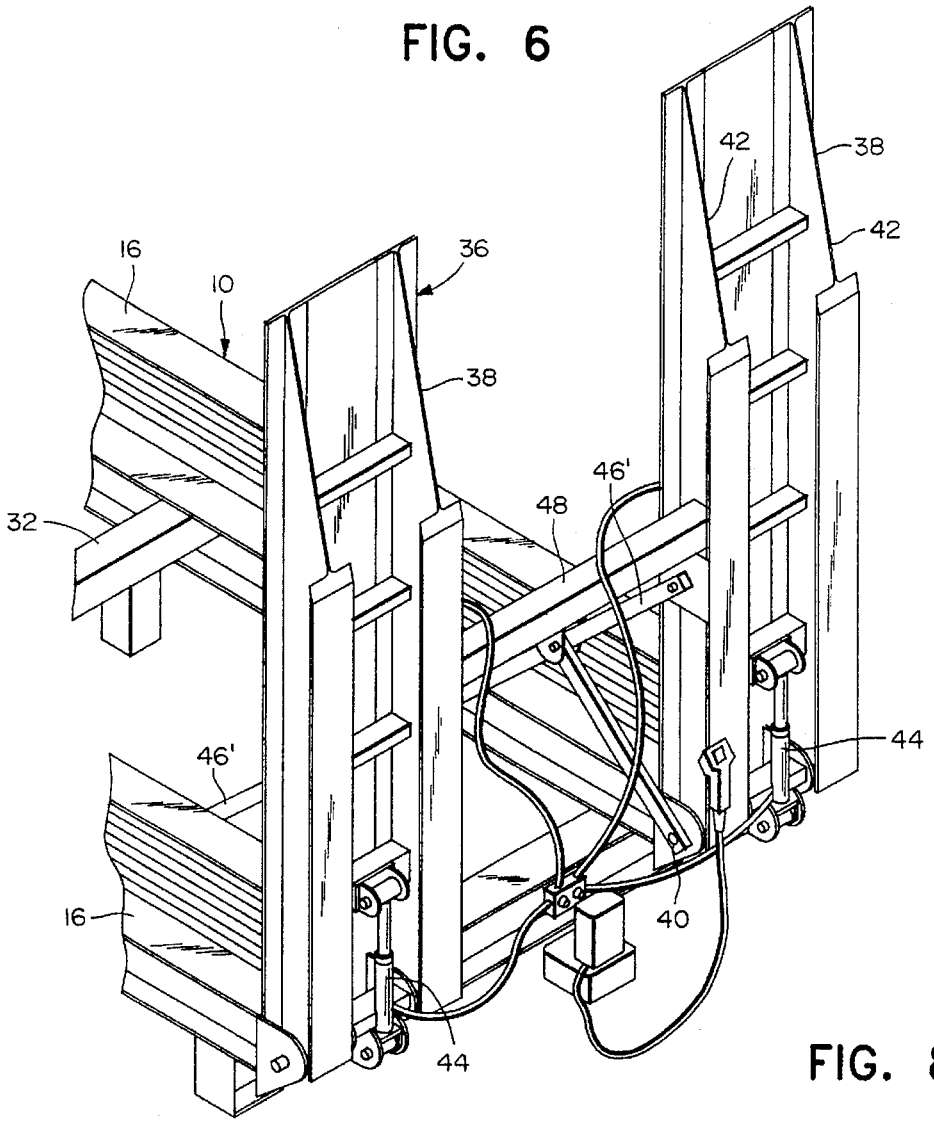
FIG. 6 is a perspective view illustrating the pivoted ramp structure equipped with a different type of angle prop equipped with a pull effecting structure.

With attention now invited more specifically to FIG. 6, the ramp assembly 36 includes the transverse brace 48 as illustrated in FIG. 2, but the mounting brackets 50 in this embodiment are omitted. Further, although the ramp assembly 36 in FIG. 2 includes inclined braces 46, the ramp assembly 36 illustrated in FIG. 6 includes a modified inclined brace 46'.

Figure 8:
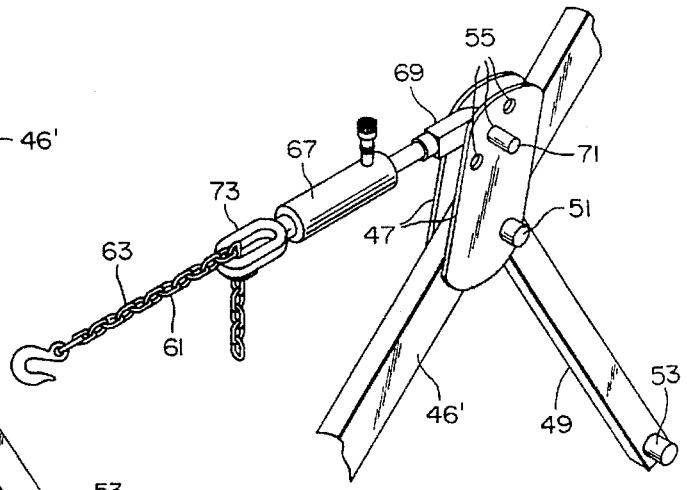
FIG. 8 is a fragmentary perspective view of the modified form of ramp prop illustrated in FIG. 6 showing the use of an independently operable pull structure provided thereon.

The modified brace 46' includes a pair of opposite side plates 47, see FIG. 8, secured preferably at the approximate longitudinal midportion of the brace 46' as by welding or the like. The lower portions of the plates 47 project below the brace 46' and pivotally mount the upper end of an oppositely inclined brace 49 therebetween through the utilization of a removable pivot pin 51. The lower end of the brace 49 includes a pivot pin 53 supported therefrom which comprises part of the pivot connection at 40 shown in FIG. 6.

Figure 7:
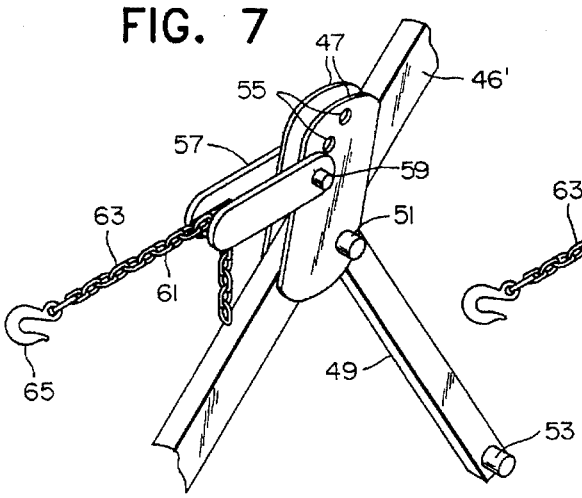
FIG. 7 is a fragmentary perspective view of a further modified form of ramp prop illustrating the use of an anchor chain in connection therewith.

The upper portions of the plates 47 have registered horizontal bores 55 formed therein and, in FIG. 7, a chain anchor 57 is secured to the plates 47 by a pivot anchor pin 59. The chain anchor 57 is releasably engageable with selected links 61 of the chain 63 having a hook 65 on its free end.

Alternately, a fluid cylinder 67 can be utilized as illustrated in FIG. 8. One end 69 of cylinder 67 is anchored between the plates 47 through the utilization of a pivot anchor pin 71 and the other end of the cylinder 67 includes a chain anchor 73 releasably anchorable with a selected link 61 of the chain 63. Accordingly, the structure illustrated in FIG. 7 may be utilized to anchor an adjacent portion of an associated vehicle (not shown) against forward movement relative to the ramp assembly 36, and the structure illustrated in FIG. 8 may be utilized to exert a rearward pull on an associated vehicle supported from the rack 10.

Figure 9:
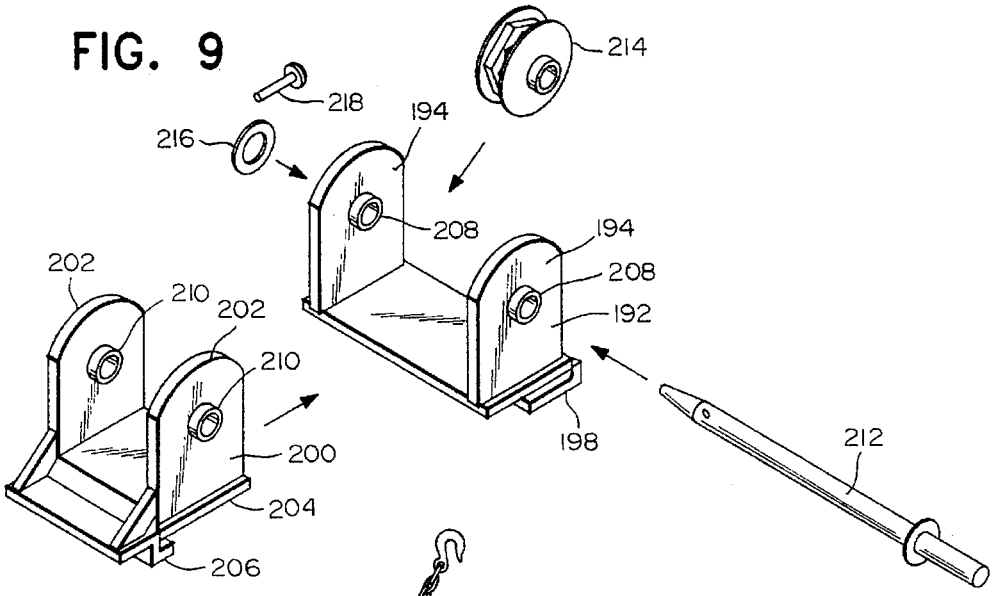
FIG. 9 is an exploded perspective view of a pull down roller assembly accessory to be used in conjunction with the rack of the instant invention.
Figure 10:
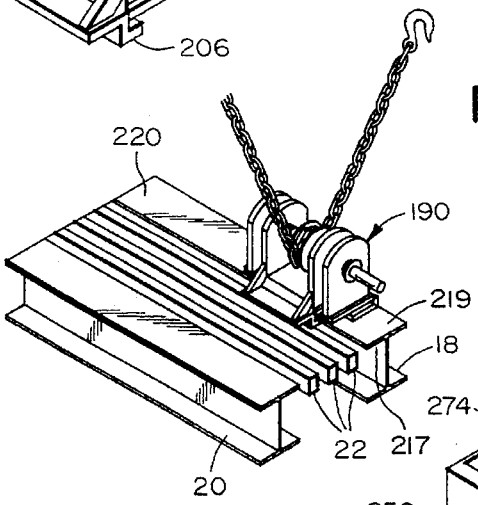
FIG. 10 is a perspective view of the pull down roller assembly of FIG. 9 in an assembled condition and mounted on a marginal portion of the associated rack for adjustable positioning therealong.

With attention now invited more specifically to FIGS. 9 and 10 of the drawings, it will be seen that chain a pull down anchor or roller assembly can be used as part of the vehicle rack of the present invention. The pull down roller assembly is referred to generally by the reference numeral 190. The assembly 190 includes a first large dimension U-shaped section or mount 192 incorporating a pair of upstanding laterally spaced side flanges 194 interconnected at their lower ends by a base flange or bight portion 196. The inner side margin of the base flange or bight portion 196 includes a downwardly projecting and back turned anchor flange or first hook 198. Also, the assembly 190 includes a second small dimension U-shaped section or mount 200 incorporating a pair of laterally spaced upstanding sides flanges 202 interconnected at their lower margins by a base flange or bight portion 204 and the outer margin of the bight portion 204 includes a downwardly projecting and inturned abutment flange or second hook 206. In addition, the side flanges 194 have registered sleeves 208 secured therethrough with which similar registered sleeves 210 secured through the side flanges 202 may be registered when the U-shaped mount 202 is superimposed on U-shaped mount 192.

An axle shaft 212 is removably secured through the sleeves 208 and 210 and rotatably journals a chain pulley 214 thereon between the side flanges 202. The shaft 212 is removably secured through the sleeves 208 through the utilization of a washer 216 and retaining pin 218.

From FIG. 10 of the drawings, it may be seen that the abutment flanges 198 and 206 tightly embrace the opposite side margins 217, 219 of the upper flange 220 of the inner I-beam 18. Of course, the pulldown roller assembly 190 may be supported from the upper flange of either the inner I-beam 18 or the outer I-beam 20, as desired. However, it will also be noted that the components of the pulldown roller assembly 190 may be readily removably engaged with either I-beam 18 or 20 and that the roller assembly 190 also may be quickly shifted longitudinally of the corresponding treadway 16.

Figure 11:
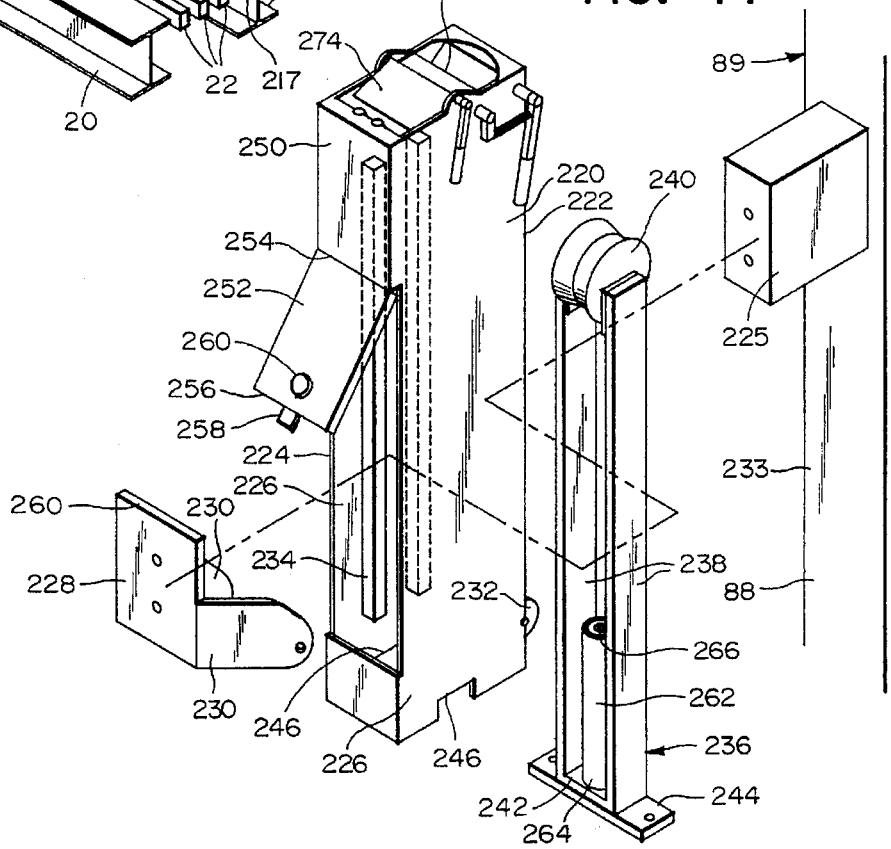
FIG. 11 is a fragmentary perspective view of the dual range pull tower structure illustrated in FIG. 3.

Referring now more specifically to FIGS. 3 and 11 which illustrate modified pull tower 89, it may be seen that the upright 88 of the pull tower 89 includes an outer side power box or housing 220 comprising chain anchor means and which is vertically disposed along the outer side of the upright 88. The housing 220 is open on its inner side 222 and includes a mid-height outer side window 224 therein. A mounting block 225 is mounted on the outer side, mid-height portion of the upright 88 and the power box or housing 220 slidingly receives the mounting block 225 between its opposite side walls 226. A retaining plate 228 is secured over the outer end of the mounting block 225 through the utilization of suitable fasteners 229 and includes slightly downwardly inclined and outwardly flared guide and anchor ears 230. The retaining plate 228 spans the window 224 and the ears 230 guidingly, embracingly receive the side walls 226 therebetween. The inner side of the lower end of the housing 220 includes guide rollers 232 journaled therefrom which are positioned to rollingly engage the outer side 233 of the upright 88.

Each of the side walls 226 includes a pair of inwardly projecting, laterally spaced and vertically extending guide rails 234 secured thereto. A roller slide assembly referred to generally by the reference numeral 236 is vertically disposed within the housing 220 and includes opposite side bars 238 guidingly received between each corresponding pair of rails 234 for guided up and down movement of the roller slide assembly 236 within the housing 220.

The upper ends of the bars 238 are interconnected by and rotatably journal a pulley wheel 240 therebetween and the lower ends of the bars 238 are interconnected by a horizontal bight member 242 beneath which a stop bar 244 is secured. The lower margins of the side walls 226 include downwardly opening notches 246 formed therein in which the extended opposite ends of the stop bar 244 are receivable. A pair of expansion springs 248 disposed exteriorly of the housing 220 are interconnected between the free ends of the guide and anchor ears 230 and the corresponding extended ends of the stop bar 244. The springs 248 thus yieldingly bias the roller slide assembly 236 upward, relative to the housing 220, to a position with the opposite ends of the stop bar 244 received in the notches 246.

The outer wall 250 of the housing 220 in which the window 224 is formed includes an upstanding door 252 pivotally supported therefrom as at 254. The upper margin of the door 252 is pivotally mounted from the outer wall 250 at the upper extremity of the window 224 and the free swinging edge 256 of the door 252 includes a rotatable latch 258 provided with an operating knob 260 on the outer side of the door 252. The latch 258 is engageable behind the upper margin 260 of the retaining plate 228 when the door 252 is in the closed position substantially coextensive with the outer wall 250 of the housing 220.

The roller slide assembly 236 includes a hydraulic cylinder 262 having the base end 264 thereof anchored relative to the bight member 242 between the lower ends of the bars 238. The hydraulic cylinder 262 also includes an upwardly extendable piston 266 engageable with the underside of the mounting block 225. Thus, extension of the hydraulic cylinder 262 causes downward movement of the roller slide assembly 236 relative to the upright 88.

The upper end of the housing 220 includes a first pair of lever operated chain movement controlling gates 270 through which a link chain 272 may readily move downwardly and pass underneath the pulley wheel 240. Also, the housing 220 includes a second pair of lever operated chain movement controlling gates 274 through which the free end of the link chain 272 may freely pass upwardly, see FIG. 3. The gates 270 and 274 may be operated to an open position in order to allow upward movement of the chain 272 past the gates 270 and downward movement of the free end of the chain 272 past the gates 274. However, gates 270 and 274 are spring loaded to a normal closed position. When the gates 270 are spring loaded to their normal closed position the chain 272 may move downwardly therethrough, but may not move upwardly therepast. Further, when gates 274 are spring loaded to their normal closed position the free end of the chain 272 may move upwardly through the gates 274, but may not move downwardly past the gates 274.

Since the mounting block 225 is received between the bars 238 and the outer end thereof which supports the retaining and guide plate 228 is flush with the outer wall 250 and the ears 230 loosely embracingly receive the housing 220 therebetween, the housing equipped with the guide rollers 232, is mounted from the upright 88 for guided vertical movement therealong, the limits of such vertical movement being defined by the upper and lower ends of the window 224.

In operation, the free end portion 273 of the chain 272 is initially arranged as illustrated in FIG. 3 and the opposite end of the chain 272 may be equipped with any suitable form of anchor structure for anchoring to a vehicle portion upon which a pull is to be exerted. Of course, the longitudinal midportion of the chain 272 passes over a pulley 280 journaled from the upper end of the upright 88 at a selected height and the chain 272 has the initial slack therein taken up by merely pulling upwardly on the free end portion 273 of the chain 272 passing upwardly through the gates 274. Thereafter, when the door 252 is latched in the closed position with the free swinging edge 256 abutted against the upper edge or margin 260 of the plate 228, the cylinder 262 is extended and moves downwardly. This extension causes the roller slide assembly 236 and the pulley wheel 240 supported therefrom to also move downwardly relative to the housing 220. This causes both reaches of the chain 272 extending between the pulley wheel 240 and the gates 270 and 274 to be increased in length, whereby further chain slack is taken up at a rate twice the rate at which the pulley wheel 240 is lowered relative to the housing 220.

Then, assuming that all slack is taken up and that the desired pull has been initiated at low force levels, the latch 258 is opened, the door 252 is swung outwardly and the cylinder 262 is further actuated. Such further downward actuation of the cylinder 262 then causes the entire housing 220, including the pulley wheel 240 and the chain section passing therebeneath, to be lowered, as a unit, relative to the mounting block 225 and thus the final pull on the chain 272 is effected at the same rate the cylinder 262 is extended.

In this manner, when the door 252 is closed to maintain the housing stationary with the upright and the cylinder 262 is actuated, only the roller slide assembly 236, including pulley wheel 240, is lowered and each one inch of downward movement of the roller slide assembly 236 upon extension of the cylinder 262 accomplishes a two inch takeup of the chain 272 between the pulley 280 and the vehicle body or frame to which the chain 272 is anchored. On the other hand, when the door 252 is open and the cylinder 262 is further downwardly extended one inch, the entire housing 222 moves downwardly with the cylinder 262 and a one inch further extension of the cylinder 262 effects only a one inch takeup of the end of the chain 272 extending around the pulley wheel 240 or between pulley wheel 280 and the vehicle to which the chain 272 is attached.

This dual pulling range action of the pull tower 89 has been found to be extremely beneficial in making accurate pulls in the shortest possible time. After the initial chain slack is taken up manually, further chain slack is taken up and a pull may be partially effected during downward movement of the roller slide assembly 236 relative to the housing 220. The final more difficult pull is accurately carried out when the door 252 is opened and downward extension of the cylinder 262 causes the entire housing 220 to move downwardly along the upright 88. Of course, the structure illustrated in FIG. 3 also may be used in connection with the pull down roller assembly 190 illustrated in FIGS. 9 and 10, and it is also possible to provide the pull tower 89 with an upward extension similar to that illustrated in FIG. 5.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a vehicle support rack including at least one peripheral portion, a pull tower supported from said peripheral portion, said pull tower including laterally spaced uprights interconnected at upper and lower ends thereof, an intermediate height portion of said uprights including vertically spaced sets of horizontally registered shaft end support structures spaced therealong, a journal shaft extending between and having opposite ends removably supported from one set of said shaft end support structures and journaling a roller therefrom intermediate said uprights, a generally horizontal stop member stationarily mounted between and from said uprights below said sets of shaft end support structures, a horizontal pull member mounted between said uprights and below said stop member for guided up and down movement relative to said uprights, said stop member and pull member having vertically registered openings formed therethrough for lengthwise receiving a length of chain therethrough passed over said roller and extending between said uprights toward said peripheral portion, fluid cylinder structure operatively connected between said uprights and pull member for selectively pulling said pull member downwardly relative to said uprights, and a pair of individual chain link engaging abutment structures releasably engageable with selected chain links disposed between said uprights and below and upwardly abuttingly engageable with said stop member and pull member, said fluid cylinder and openings being aligned along a straight path.

2. The combination of claim 1 including an elongated, upstanding upper tower extension removably anchored to the upper end of said tower and an auxiliary fluid cylinder having one end pivotally anchored an upper portion of said extension for swinging about an axis generally paralleling the axis of rotation of said roller and a second end having a length of pull chain adjustably anchored relative thereto.

3. The combination of claim 1 wherein said pull tower and peripheral portion includes coacting means supporting said pull tower from said marginal portion for adjustable shifting therealong.

4. In combination, a vehicle support rack including at least one peripheral portion incorporating inner and outer margins defined by I-beams having upper and lower flanges interconnected by an upstanding web, an upright pull tower including upper and lower ends, said lower end including a laterally directed base portion underlying said peripheral portion and including an inner end remote from said lower end of said tower and an outer end supporting said lower end of said tower, said inner end including journaled first roller structure rollingly engaging a generally flat underside of the lower flange of said inner margin I-beam and a hook portion closely overlying said lower flange, said outer end including journaled second roller structure rollingly engaging a generally flat upper side of said lower flange and abutment structure closely underlying the upper flange of said outer marginal I-beam, the weight of said tower over balancing said outer end of said base portion, said pull tower upper end including pull structure for exerting a generally outward pull on a portion of a vehicle disposed on said rack and causing said hook portion to engage said overlaid lower flange and said abutment structure to engage said underlaid upper flange to prevent movement of said pull tower along said peripheral portion.

5. A vehicle support rack including opposite side longitudinal peripheral portions and front and rear ends, said rack being elevated above a support surface therefor, elongated rear ramp structure including base and free ends, means pivotally supporting said base end from the rear end of said rack for vertical swinging of said ramp structure between a rearwardly and downwardly inclined position and a substantially vertical upwardly projecting position, fluid cylinder force generating structure operatively connected between said rack and ramp structure for swinging said ramp structure relative to said rack, elongated, forwardly and downwardly directed inclined opposite side braces releasably connected between opposite side intermediate length portions of said ramp structure and said rack forward of said rear end, and pull force generating structure anchored relative to said intermediate length portion and projecting forwardly therefrom and anchorable to a body portion of a vehicle disposed on and anchored relative to said rack for exerting a rearward pull on said body portion.

6. The vehicle support rack of claim 5 wherein said pull force generating structure is anchored relative to said ramp structure, independent of said braces.

7. The vehicle support rack of claim 5 wherein said pull force generating structure is anchored relative to mid-length portions of said braces, and rearwardly and downwardly inclined, opposite side second braces extending between and anchored relative to said mid-length portions and opposite side portions of said rear end.

8. In combination with a vehicle support rack of the type including a marginal portion defined by an I-beam including an upper flange having remote longitudinal margins, a chain pull down anchor, said anchor including a first section defining a horizontal first base flange and first laterally spaced upstanding side flanges carried by said first base flange, said first base flange including downwardly directed and reverse turned first hook extending along a first margin of said base flange and extending between generally parallel planes containing said first upstanding flanges, a second section including a horizontal second base flange and second laterally spaced upstanding side flanges carried by said second base flange, said second base flange being removably supported from said first base flange with said second upstanding flanges received between said first upstanding flanges, said second base flange including a margin thereof remote from said first margin and including depending and reverse turned second hook opening towards said first hook, said first base flange being supported from said upper flange with said first and second hooks engaged with and underlying said remote marginal portions, said first and second upstanding flanges including registered horizontal bores formed therethrough, an elongated journal and anchor pin removably secured through said bores and a flanged roller removably journaled on said pin between said second upstanding flanges.

9. In combination, a vehicle support rack including at least one peripheral portion, an upright vehicle pull tower supported from said peripheral portion, said pull tower including an upright having an upper portion and a lower portion, a pulley journaled from said upper portion for rotation about a horizontal axis, a chain passed over said pulley and having one end portion depending downwardly therefrom, stop structure mounted from said lower portion, pull structure mounted from said lower portion below said stop structure for guided up and down movement relative to said upright, said stop and pull structures having vertically registered openings formed therethrough lengthwise receiving said chain one end portion therethrough, fluid cylinder structure operatively connected between said upright and pull member for selectively pulling said pull member downwardly relative to said upright, and a pair of individual chain link engaging abutment structures releasably engageable with selected chain links below and upwardly abuttingly engageable with said stop member and said pull member, said fluid cylinder and openings being aligned along a straight path.

10. A vehicle support rack including at least one peripheral portion, a pull tower including upper and lower ends, said lower end including a base portion for stationary positioning relative to a vehicle upon which frame and/or body pulls are to be performed, said upper end including roller structure journaled therefrom for rotation about a horizontal axis, a pull chain including a longitudinal mid-portion trained over said pulley, a first end portion for attachment to said vehicle and a second end portion depending downward from said pulley, linear motion force structure mounted from said tower below said pulley for guided powered movement downwardly along said tower, and connecting structure operatively connected between said chain second end portion and said linear motion force structure for applying a downward force on said chain second end portion responsive to downward movement of said force structure along said tower, said connecting structure including force transfer structure defining selectively operable first and second modes of operation operative to effect two and one length unit downward pulls, respectively, on said chain second end portion responsive to a one length unit downward movement of said force structure along said tower.

* * * * *